252-95 AU 166 EX
10/31/78 XR 4,123,375

United States Patent [19]
Altenschöpfer et al.

[11] 4,123,375
[45] Oct. 31, 1978

[54] DISHWASHER DETERGENT WITH CLEAR RINSING EFFECT AND METHOD OF MACHINE WASHING DISHES

[75] Inventors: Theodor Altenschöpfer, Dusseldorf-Holthausen; Albertus van Wageningen, Erkrath-Unterbach, both of Germany

[73] Assignee: Henkel Kommanditgesellschaft auf Aktien, Dusseldorf-Holthausen, Germany

[21] Appl. No.: 743,472

[22] Filed: Nov. 19, 1976

[30] Foreign Application Priority Data

Nov. 22, 1975 [DE] Fed. Rep. of Germany ..... 2552506

[51] Int. Cl.[2] ..... A47L 15/02; C11D 3/20; C11D 3/395; C11D 7/56

[52] U.S. Cl. ..... 252/99; 252/89 R; 252/95; 252/135; 252/DIG. 11

[58] Field of Search ..... 252/89, 95, 99, 135, 252/102, 132, 524, DIG. 11

[56] References Cited

U.S. PATENT DOCUMENTS

| | | | |
|---|---|---|---|
| 3,692,684 | 9/1972 | Hentschel | 252/89 |
| 3,701,735 | 10/1972 | Finck | 252/99 |
| 3,708,427 | 1/1973 | Jakobi | 252/99 |
| 3,764,559 | 10/1973 | Mizuno | 252/99 |
| 3,821,118 | 6/1974 | Finck | 252/99 |
| 3,888,781 | 6/1975 | Kingry | 252/99 |
| 3,899,436 | 8/1975 | Copeland | 252/99 |

FOREIGN PATENT DOCUMENTS

| | | | |
|---|---|---|---|
| 2,130,382 | 3/1972 | France | 252/99 |
| 2,132,802 | 11/1972 | France | 252/99 |

*Primary Examiner*—Dennis L. Albrecht
*Attorney, Agent, or Firm*—Hammond & Littell

[57] ABSTRACT

A powdered dishwasher detergent with a clear rinsing effect consisting essentially of water-soluble salts of condensed phosphates, silicates, carbonates, hydroxides, citrates, as well as nonionic surface-active compounds and compounds releasing chlorine in aqueous solutions comprising from 3.5% to 8% by weight on an anhydrous basis of compounds releasing active chlorine in aqueous solutions, from 3.5% to 10% by weight of low sudsing nonionic surface-active compounds, from 5% to 20% by weight of water-soluble salts of citric acid, and from 0 to 10% by weight of water-soluble salts of an organic monocarboxylic acid or an organic polycarboxylic acid; as well as the process of machine washing dishes employing the above detergent.

1 Claim, No Drawings

DISHWASHER DETERGENT WITH CLEAR RINSING EFFECT AND METHOD OF MACHINE WASHING DISHES

BACKGROUND OF THE INVENTION

The mechanical washing of dishes is effected, as known, in several steps, generally called "cycles," where one or more intermediate rinsing cycles with clear water are arranged between the washing cycle proper and the final clear rinsing cycle in order to reduce the entrainment of dirty liquor. Generally two different agents are used for the washing cycle and clear rinse cycle, namely a dishwashing agent (cleanser) and a clear rinsing agent (clear rinse) (Ullmanns Encyklopaedie der technischen Chemie, 14 (1963) p. 656 and DOS 2,259,830).

The cleanser has the function of swelling the food residues during the washing cycle of the dishwashing machine, to detach them from the dishes, and to disperse them in the cleanser liquor.

In the last rinse cycle the dishes are rinsed with addition of the clear rinse agent. The clear rinse agent has the function according to its composition, on the one hand, of lowering the surface tension of the water so that it forms a closed film on the dish surface, which becomes increasingly thinner on runoff and which disappears finally, and on the other hand, to ensure that the dishes have a uniform shine after drying.

With the use of this combination of a cleanser and clear rinse agent, even delicate dishes are washed gently and satisfactorily and rinsed to a dry shine in modern dishwashing machines. But it is an inconvenience that it is necessary to use two different preparations to obtain a good result, which must in addition be specifically adapted to each other.

OBJECTS OF THE INVENTION

An object of the present invention is to develop a product which performs the job of the conventional two-component combination of cleanser and clear rinse agent simultaneously, and particularly with a single application, in a dishwashing machine.

Another object of the present invention is the development of a powdered dishwasher detergent with a clear rinsing effect consisting essentially of from 7% to 18% by weight on an anhydrous basis of component A and 82% to 93% by weight on an anhydrous basis of component B, wherein component A contains from 3.5% to 10% by weight of the anhydrous composition of low-sudsing nonionic surface-active compounds and from 3.5% to 8% by weight of the anhydrous composition of a compound releasing active chlorine in aqueous solution and component B contains from 10% to 76.5% by weight of the anhydrous composition of a water-soluble condensed alkali metal phosphate, from 10% to 60% by weight of the anhydrous composition of a water-soluble alkali metal silicate, from 0 to 5% by weight of the anhydrous composition of a wash alkali selected from the group consisting of alkali metal hydroxides and alkali metal carbonates, from 5% to 20% by weight of the anhydrous composition of an alkali metal citrate, from 0 to 10% by weight of the anhydrous composition of a water-soluble alkali metal salt of a carboxylic acid selected from the group consisting of lower alkanoic acids and lower alkanedioic acids, and from 0 to 10% by weight of the anhydrous composition of a member selected from the group consisting of alkali metal chlorides, alkali metal sulfates, dyes, perfumes, inorganic calcium compound corrosion inhibitors and hydrophilic microcrystalline silica.

A further object of the present invention is the development of a method of machine dishwashing employing the above composition.

These and other objects of the invention will become more apparent as the description thereof proceeds.

DESCRIPTION OF THE INVENTION

The drawbacks of the prior art have been overcome and the above objects have been achieved by our discovery of a powdered dishwasher detergent with a clear rinsing effect with a content of condensed phosphates, silicates, alkalies, salts of citric acid, nonionic surface-active compounds, and compounds releasing chlorine in aqueous solution, characterized in that it contains from 3.5% to 8% by weight of compounds releasing active chlorine in aqueous solution and from 3.5% to 10% by weight of low-sudsing, nonionic surface-active compounds, and 5% to 20% by weight of water-soluble salts of citric acid, and, optionally alkali metal salts of other organic mono- or polycarboxylic acids. All weights are based on the total weight of the above-indicated components, excluding any adhering water or water of hydration.

Cleansers for machine dishwashing with a content of condensed alkali metal phosphates, additional alkaline builder substances, salts of citric acid, as well as an additional content of compounds releasing chlorine and, optionally, low-sudsing or nonsudsing surface-active compounds, are known and described in German Published Patent Application DOS 2142055 and 2259830, corresponding to U.S. Pat. No. 3,899,436 partially and British Patent No. 1,396,678, respectively. However, little attention was given heretofore to the content of the surface-active compounds, and the compounds releasing active chlorine were used substantially only in cleansers for specific cleaning jobs.

We have found surprisingly, however, that the joint use of low-sudsing nonionic surface-active compounds and compounds releasing active chlorine, in relatively larger and controlled amounts, which will be called for simplicity's sake component group A, while increasing the portion of water-soluble salts, preferably trialkali metal salts, of citric acid in the builder substances, called for simplicity's sake component group B, leads to a dishwasher detergent which, when added once to the dishwasher, shows not only just as good, if not a better cleaning result, but also has at the same time a better clear-drying effect than the use of the known preparations according to the state of the art, even if a special clear rinse is subsequently added. These differences are particularly apparent when working with hard water.

A low-sudsing nonionic surface-active compound is one which, according to the procedures of DIN 53 902 gives a suds on agitation, of from 10 to 80 ml of 50° C immediately after cessation of the agitation. The test is conducted as follows: At a dosage level of 0–1 gm. nonionic surface-active compound per 200 ml of distilled water, aqueous solutions of the compounds were stamped 30 times at 50° C in a measuring cylinder with a perforated disk and after 30 seconds the foam volume in milliliters was recorded.

The detergents according to the present invention contain the following (all weights are % by weight of the total anhydrous composition):

Component A:

3.5% to 10%, preferably 5% to 10% of a low-sudsing nonionic surface-active compound, preferably from the group of alkylene oxide adducts of higher fatty alcohols of natural or synthetic origin, or alkylphenols with 12 to 18 carbon atoms in the alkyl, or of polypropylene glycols with a molar weight of 900 – 4000, and 3.5% to 8% of a compound releasing active chlorine in aqueous solution, as well as Component B:

10% to 76.5% of a water-soluble condensed alkali metal phosphate

10% to 60% of a water-soluble alkali metal silicate 0 to 5% of an alkali metal hydroxide or an alkali metal carbonate 5% to 20% of a water-soluble salt, preferably a trialkali metal salt, of citric acid, and 0 to 10% of a mono- or polyalkali metal salt of an organic mono- or polycarboxylic acid.

Preferably component A amounts to at least 8.5%.

More particularly, the composition of the invention is a powdered dishwasher detergent with a clear rinsing effect consisting essentially of from 7% to 18% by weight on an anhydrous basis of component A and 82% to 93% by weight on an anhydrous basis of component B, wherein component A contains from 3.5% to 10% by weight of the anhydrous composition of low-sudsing nonionic surface-active compounds and from 3.5% to 8% by weight of the anhydrous composition of a compound releasing active chlorine in aqueous solution and component B contains from 10% to 76.5% by weight of the anhydrous composition of a water-soluble condensed alkali metal phosphate, from 10% to 60% by weight of the anhydrous composition of a water-soluble alkali metal silicate, from 0 to 5% by weight of the anhydrous composition of a wash alkali selected from the group consisting of alkali metal hydroxides and alkali metal carbonates, from 5% to 20% by weight of the anhydrous composition of an alkali metal citrate, from 0 to 10% by weight of the anhydrous composition of a water-soluble alkali metal salt of a carboxylic acid selected from the group consisting of lower alkanoic acids and lower alkanedioic acids, and from 0 to 10% by weight of the anhydrous composition of a member selected from the group consisting of alkali metal chlorides, alkali metal sulfates, dyes, perfumes, inorganic calcium compound corrosion inhibitors and hydrophilic microcrystalline silica.

Suitable condensed phosphates in the sense of the invention are the water-soluble alkali metal pyrophosphates or tripolyphosphates or the water-soluble alkali metal hexametaphosphates which are generally used as sequestrants in dishwasher detergents.

The water-soluble alkali metal silicates are preferably sodium or potassium metasilicates, where the ratio of alkali metal oxide to silicon oxide is about 1:0.5 to 3.5. As far as alkali metal hydroxides or alkali metal carbonates are used in the mixtures sodium hydroxide or potassium hydroxide or the corresponding carbonates are given preference. However, not more than 30% by weight of the alkali metal silicates should be replaced by the caustic alkalies, since the greater alkaline reaction achieved here can lead to an increased corrosion effect of the cleanser.

The low-sudsing, nonionic surface-active compounds are preferably ethylene oxide adducts with higher molecular weight polypropylene glycols with a molar weight of 900 to 4000, where the weight ratio of oxypropylene to oxyethylene is from 20:1 to 3:1, as well as adducts of ethylene oxide or ethylene oxide and propylene oxide with alkanepolyols, such as propane diol, with higher fatty alcohols, like dodecyl alcohol, palmityl alcohol, stearyl alcohol, oleyl alcohol and mixtures thereof, as well as with synthetic straight-chained and branched-chained, primary or secondary alkanols having 12 to 18 carbon atoms produced by oxo synthesis, or the corresponding alkylene oxide adducts with alkylated phenols having 6 to 18 carbon atoms in the alkyls, such as nonylphenol. Where mixed ethylene oxide/propylene oxide adducts are employed, the weight ratio of oxypropylene to oxyethylene is from 20:1 to 3:1. When ethylene oxide adducts are employed, the amount of ethylene oxide adducted is from 3 to 15 mols. The production of these low-sudsing nonionic surface-active compounds is made in a known manner by adding the alkylene oxides in the presence of alkaline catalysts, if necessary under pressure and elevated temperatures, where up to the three fold amount by weight of alkylene oxides are added onto the starting materials. An example of a suitable addition product of ethylene oxide onto a polyoxypropylene glycol with a molecular weight of 1900, is commercially available under the tradename "Pluronic ® L 61," where the amount of the oxypropylene moieties is 90% by weight, and the amount of the oxyethylene moieties is 10% by weight.

The compounds releasing active chlorine are preferably the alkali metal salts of isocyanuric acids, such as potassium and sodium dichloroisocyanurate or its dihydrate. Furthermore alkali metal and alkaline earth metal hypochlorites, such as iithium hypochlorite, sodium hypochlorite, or calcium hypochlorite, as well as complex salts containing hypochlorites, such as the so-called chlorinated phosphates, trichloromelamine, "Chloramine T", and other compounds releasing active chlorine can be used. The amounts indicated within the framework of the specification refer to salts which contain no water of hydration, unless stated otherwise.

The water-soluble salts of citric acid are preferably the trialkali metal salts, particularly trisodium citrate. Commercial "sodium citrate" is generally trisodium citrate dihydrate, commercial "potassium citrate" is tripotassium citrate monohydrate. Both are used as white, fine crystals or in powder form. The amounts indicated within the framework of the specification refer to salts which contain no water of hydration, unless stated otherwise.

Apart from the above-mentioned components, the claimed mixtures can contain, if necessary, smaller amounts of additional components, particularly inorganic salts, for example, the alkali metal sulfates and chlorides, such as sodium sulfate or sodium chloride. Other possible additions are buffering salts for example alkali metal salts of weak acids, such as sodium acetate, dyes, perfumes, corrosion inhibitors for example calcium compounds, such as $Ca(OH)_2$, etc. The amount of the builder salts of the preparations would necessarily be slightly reduced if all components together are to amount to 100%.

The claimed powdered detergents are prepared in a known manner by grinding and mixing the components. In order to obtain an intimate bond of the components, it may be advisable to spray the powder during the mixing or thereafter with an aqueous solution of crystallizing salts, such as sodium sulfate, or with one of the above-mentioned nonionic surface-active compounds.

This treatment at the same time reduces the tendency of the powder to dusting.

In order to ensure the trickling capacity of the powder mixtures over a prolonged time, it is advisable to admix hydrophilic microcrystalline silica therewith in quantities of from 0 to 5% by weight, as described in DOS 2,134,695.

The detergent composition of the invention are characterized by a high cleaning power. They are particularly suitable to remove burnt, protein-containing food residues, lipstick traces and tea strains. They can prevent the formation of starch coatings on the dish surfaces or to remove existing coatings. The low corrosion effect of the compositions of the invention, especially on porcelain over-glaze designs, is to be particularly stressed.

The detergent compositions of the present invention can be used both in household dishwashers and in commercial dishwashers. They are added by hand or by suitable dosing devices. They are employed in the cleaning liquors in concentrations of about 0.5 to 10 gm/l, preferably 2 to 5 gm/l. The pH-values of the cleaning liquors are between 7 and 12, preferably 8 to 11.

The advantages of the detergent compositions of the present invention are that no clear rinse agent need by added in the last rinse cycle, that tap water only is used for rinsing, and that a good clear rinsing result is nevertheless achieved. The dishes so washed without a clear rinsing agent have a result after washing which is at least just as good or even better than that according to the conventional method by using two component combination of a cleanser and clear rinse agent. The handling of the dishwasher is facilitated since it suffices, after the washing cycle, using only the new dishwasher detergent, to rinse the dishes with clear water and to dry them subsequently as usual. After drying completely clean and sanitary dishes are obtained.

The present invention therefore also concerns a method for the simultaneously washing and rinsing of dishes in dishwashing machines, which is characterized by the use of and the single and sole addition of the claimed detergents in one cleaning cycle.

More particularly the above method is, in the method of washing dishes in a mechanical dishwasher comprising the steps of subjecting the soiled dishes to the forceful spraying of a cleansing liquor containing a dishwahing detergent, rinsing said dishes with a forceful spray of clear water, subjecting the cleaned dishes to the forceful spraying of a clear rinse liquor, and drying said clean dishes, the improvement consisting essentially of employing a powdered dishwasher detergent with a clear rinsing effect consisting essentially of from 7% to 18% by weight on an anhydrous basis of component A and 82% to 93% by weight on an anhydrous basis of component B, wherein component A contains from 3.5% to 10% by weight of the anhydrous composition of low-sudsing nonionic surface-active compounds and from 3.5% to 8% by weight of the anhydrous composition of a compound releasing active chlorine in aqueous solution and component B contains from 10% to 76.5% by weight of the anhydrous composition of a water-soluble condensed alkali metal phosphate, from 10% to 60% by weight of the anhydrous composition of a water-soluble alkali metal silicate, from 0 to 5% by weight of the anhydrous composition of a wash alkali selected from the group consisting of alkali metal hydroxides and alkali metal carbonates, from 5% to 20% by weight of the anhydrous composition of an alkali metal citrate, from 0 to 10% by weight of the anhydrous composition of a water-soluble alkali metal salt of a carboxylic acid selected from the group consisting of lower alkanoic acids and lower alkanedioic acids, and from 0 to 10% by weight of the anhydrous composition of a member selected from the group consisting of alkali metal chlorides, alkali metal sulfates, dyes, perfumes, inorganic calcium compound corrosion inhibitors and hydrophilic microcrystalline silica, as a combination of dishwashing detergent and clear rinse agent.

By simplified control and by eliminating the dosing it is possible to build cheaper household dishwashing machines. The constant action of alkaline cleansers and acidic clear rinses on the dishes is eliminated. This way porcelain over-glaze designs, glasses, knife edges, etc. are even more protected than heretofore.

The following examples are illustrative of the present invention without being limitative in any respect.

EXAMPLES

In standard readily available household dishwashing machines, such as Bosch SA 12 SM or Bauknecht GS 561, the cleaning results and clear drying effects of the detergent compositions of the invention were tested in the so-called standard program.

For testing the cleaning results, glass plates were utilized which were coated with the burnt food residues of milk, chocolate pudding or chopped meat, as well as cereal bowls with dried residues of oatmeal or starch and cups with dried residues of tea (this test is described in the publication "Testing of cleansers and clear rinses agents for machine-dishwashing" in Seifen-Ole-Fette-Wachse, 98, (1972) p. 763 ff and 801 ff) were washed in the household dishwashing machine with 3 gm of detergent per liter of wash liquor in the cleaning cycle. The soilings were so selected that removal with other customary cleansers, which have a high cleaning power, was only partly possible, in order to still have differentiating possibilities in these highly effective products. For the individual grades, a point system ranging from 10 to 0, where 10 points means "without recognizable cleaning effect" and 0 points means "complete removal of test soilings," was utilized.

For the evaluation of the clear drying effect 6 glasses soiled with colored wax pencil were employed. For the evaluation of the clear-drying effect likewise a 10 point system was employed, where 10 points means "completely inadequate clear-drying (streaks, spots, etc.)" and 0 points means "perfect clear-drying (shining glasses without streaks and spots)." The mean values of the cleaning and clear-drying results were determined in different household dishwashers in several tests for each example of detergent studied. For comparison, the mean values of the cleaning and clear-drying results of a commercial cleanser, with and without the use of a commercial clear rinse were also determined.

The commercial cleanser had the following composition: 56% pentasodium tripolyphosphate, 36% sodium metasilicate, 5% sodium carbonate, 2% sodium dichloroisocyanurate, and 1% nonionic surface-active compound. It was used in a concentration of 3 gm/l of wash liquor.

The commercial clear rinse agent was composed of 20% of a nonionic surface-active compound and 20% citric acid in aqueous solution, and was used in a concentration of 0.4 gm/l of clear rinse liquor.

EXAMPLE 1

A detergent of the following composition was prepared and tested without the use of a clear rinse.

48.0% pentasodium tripolyphosphate,
33.0% sodium metasilicate with a ratio of sodium oxide to silicon oxide of 1:0.98
4.0% sodium dichloroisocyanurate
6.0% low-sudsing, nonionic surface-active compound (Pluronic ® L 61)
9.0% trisodium citrate-dihydrate.

The dishes dirtied as above were washed several times in different dishwashing machines. For comparison, the commercial cleanser with a commercial clear rinse of the above indicated formula, and without the use of clear rinse, was also employed and repeated below.

The following mean values of the cleaning and clear drying results were determined form the tests:

Clear-drying effect on glasses

| | |
|---|---|
| Detergent according to Example 1 | 1.9 |
| Commercial cleanser followed by clear rinse agent | 2.5 |
| Commercial cleanser without clear rinse agent | 4.1 |

| Test results | Cleanser according to Example 1 | Commercial cleanser followed by clear rinse agent |
|---|---|---|
| removal of | | |
| milk | 0 | 0 |
| tea | 0 | 0 |
| wax pencil | 0 | 0 |
| chopped meat | 2 | 1.5 |
| chocolate pudding | 1.5 | 1 |
| oatmeal | 3 | 2 |
| starch | 4 | 4 |

EXAMPLE 2

A detergent of the following composition was used without a clear rinse.

40.0% pentasodium tripolyphosphate
33.0% sodium metasilicate with a ratio of sodium oxide to silicon oxide of 1:0.98
4.5% sodium dichloroisocyanurate-dihydrate
6.0% of a low-sudsing, nonionic surface-active compound from the class of the ethoxylated and propoxylated propane diol adducted with 90 mols of propylene oxide and 10 mols of ethylene oxide.
16.5% trisodium citrate-dihydrate

| | |
|---|---|
| Clear-drying effect on glasses: | 2 |
| Cleaning results | |
| removal of milk | 0 |
| tea | 0 |
| wax pencil | 0 |
| chopped meat | 1.5 |
| chocolate pudding | 0 |
| oatmeal | 2.5 |
| starch | 3.5 |

EXAMPLE 3

In this example, as in Examples 1 and 2, the dishes were washed with the following detergent without the use of a clear rinsing agent. The detergent contained, in addition to the citrate, also the sodium salt of acetic acid and had the following composition:

40.0% pentasodium tripolyphosphate
40.0% sodium metasilicate with a ratio of sodium oxide to silicon oxide 1:0.98
5.0% sodium dichloroisocyanurate-dihydrate
5.0% of a low-sudsing, nonionic surface-active compound from the class of the ethoxylated and propoxylated secondary fatty alcohols with 12 to 14 carbon atoms adducted with 5 mols of propylene oxide and 8 mols of ethylene oxide.
7.0 trisodium citrate anhydrous
3.0% sodium acetate

| | |
|---|---|
| Clear drying effect on glasses | 2.2 |
| Cleaning results | |
| removal of milk | 0 |
| tea | 0 |
| wax pencil | 0 |
| chopped meat | 2 |
| chocolate pudding | 1 |
| oatmeal | 1.5 |
| starch | 4 |

The composition and the results of the application of the three detergents according to the invention described above are combined in the following Table I with 5 other examples and reproduced with the composition and the result of a commercial cleanser, with and without the additional use of a clear rinse. The carrier of active chlorine indicated by + is sodium dichloroisocyanurate dihydrate, the usual carrier of active chlorine employed was sodium dichloroisocyanurate. The low-sudsing nonionic tenside of Examples 1, 4 and 6 consisted of the above defined Pluronic ® L 61, of the Examples 2, 5 and 7, it consisted of propane diol, which was adducted with 10 mols of ethylene oxide and 90 mols of propylene oxide. In the Examples 3 and 8, a secondary fatty alcohol having 12 to 14 carbon atoms which was adducted with 8 mols of ethylene oxide and 5 mols of propylene oxide was employed. The better results of the detergent combination according to the invention can be clearly seen.

TABLE I

| | % $Na_5P_3O_{10}$ | % $Na_2SiO_3$* | % Carrier of Active Cl | % Tenside | % Citrate | % a $Na_2Co_3$ b $NaO_2CCH_3$ | Clear Drying Effect Glasses | Milk Tea Wax Pencil | Chopped Meat | Cleaning (removal of) Choc. pudding | oat meal | Starch |
|---|---|---|---|---|---|---|---|---|---|---|---|---|
| Example 1 | 48.0 | 33.0 | 4.0 | 6.0 | 9.0 | — | 1.9 | 0 | 2 | 1.5 | 3 | 4 |
| Example 2 | 40.0 | 33.0 | $4.5^{+}$ | 6.0 | 16.5 | — | 2 | 0 | 1.5 | 0 | 2.5 | 3.5 |
| Example 3 | 40.0 | 40.0 | $5.0^{+}$ | 5.0 | 7.0 | b) 3.0 | 2.2 | 0 | 2 | 1 | 1.5 | 4 |
| Example 4 | 47.1 | 32.3 | 5.9 | 7.8 | 6.9 | — | 2.4 | 0 | 0.5 | 0.5 | 2 | 4 |
| Example 5 | 40.0 | 40.0 | $5.0^{+}$ | 5.0 | 7.0 | b) 3.0 | 2.1 | 0 | 3 | 0.5 | 2 | 3 |
| Example 6 | 45.3 | 31.1 | 5.7 | 7.5 | 10.4 | — | 2.5 | 0 | 1 | 1 | 3 | 3.5 |
| Example 7 | 42.5 | 37.5 | $5.0^{+5.0}$ | 7.0 | b) 3.0 | 2.2 | 0 | 3.5 | 1 | 3 | 4 | |
| Example 8 | 42.5 | 37.5 | $5.0^{+}$ | 5.0 | 7.0 | b) 3.0 | 2.3 | 0 | 1 | 1 | 2.5 | 3.5 |
| Commercial cleanser followed by clear rinse agent | 56.0 | 36.0 | 2.0 | 1.0 | — | a) 5.0 | 2.5 | 0 | 1.5 | 1 | 2 | 4 |

TABLE I-continued

| | % $Na_5P_3O_{10}$ | % $Na_2SiO_3$* | % Carrier of Active Cl | % Tenside | % Citrate | % a $Na_2Co_3$ b $NaO_2CCH_3$ | Clear Drying Effect Glasses | Milk Tea Wax Pencil | Chopped Meat | Cleaning (removal of) Choc. pudding | oat meal | Starch |
|---|---|---|---|---|---|---|---|---|---|---|---|---|
| Commercial cleanser without clear rinse agent | 56.0 | 36.0 | 2.0 | 1.0 | — | a) 5.0 | 4.1 | 0 | 1.5 | 1 | 3 | 4.5 |

*ratio $SiO_2$: $Na_2O$ = 0.98

In another test series, a formulation according to the invention (Example 9) was compared with five formulations which belong to the state of the art according to DOS 2,142,055, corresponding partially to U.S. Pat. No. 3,899,436. Since no exact data are given in the published German application about the amount of carrier of active chlorine and nonionic surface active compounds, the ordinary known amounts were employed. The tests were made in the household dishwashing machine Bosch SA 12 SM with hard water and in the machine Bauknecht GS 561 with softened water each at a concentration of 3 gm of cleanser/1 of water without the use of a clear rinse agent.

As it can be seen from Table II, none of the formulas 1 to 5 according to DOS 2,142,055 yields the good cleaning results of Example 9 according to the present invention. The differences become particularly clear when hard water is used (top lines of the right half of the table). The same holds true for the clear-drying effect; 10 points = poor clear-drying effect (spots, coating drops, etc.) 0 points = percent clear-drying effect. Three mean values of three test series are given in Table II.

TABLE 11

| Example | % $Na_5P_3O_{10}$ | % $Na_2SiO_3$ | % Carrier of active Cl | % Tenside[2] | % Citrate | % $Na_2CO_3$ | Clear Drying effect Glasses | Cleaning Removal of Milk | Chopped meat | Choc. Pudding | Oat Meal | Starch |
|---|---|---|---|---|---|---|---|---|---|---|---|---|
| Example 9 | 47.7 | 32.8 | 4.5 | 6.0 | 9.0 | — | 2.0 | 0 | 2.5 | 2 | 4.5 | 6 |
| | | | | | | | 1.9 | 0 | 2 | 1.5 | 3 | 4 |
| DOS 1 | 5.1 | 25.0 | 2.25 | — | 25.0 | 42.65 | 4.3 | 2.5 | 3.5 | 4.5 | 5 | 7 |
| | | | | | | | 3.6 | 1 | 2 | 2.5 | 5 | 6 |
| DOS 2 | 5.1 | 25.0 | 2.25 | 2.0 | 25.0 | 40.65 | 4.3 | 3 | 4 | 5 | 4.5 | 6.5 |
| | | | | | | | 4 | 1 | 2.5 | 3 | 4.5 | 6 |
| DOS 3 | 30.0 | 25.0 | 2.25 | 2.0 | 25.0 | 15.75 | 4.7 | 3 | 4.5 | 4.5 | 5.5 | 7 |
| | | | | | | | 4 | 1 | 1.5 | 2.5 | 4.5 | 6 |
| DOS 4 | 30.0 | 25.0 | 5.0 | 6.0 | 25.0 | 9.0 | 4.3 | 4 | 5 | 4.5 | 6 | 7 |
| | | | | | | | 4 | 0.5 | 2.5 | 2.5 | 4.5 | 6 |
| DOS 5 | 10.75 | 25.0 | 2.25 | 2.0 | 60.0 | — | 5 | 3 | 4 | 4.5 | 6 | 7 |
| | | | | | | | 5 | 3 | 3.5 | 4 | 5.5 | 6.5 |

[1]$SiO_2$: $Na_2O$ ratio = 0.98
[2]Pluronic ® L 61;

The preceeding specific embodiments are illustrative of the practice of the invention. It is to be understood however, that other expedients known to those skilled in the art, or disclosed herein, may be employed without departing from the spirit of the invention or the scope of the appended claims.

We claim:

1. A powdered dishwasher detergent with a clear rinsing effect consisting essentially of 40% by weight of sodium tripolyphosphate, 40% by weight of sodium metasilicate, 5% by weight of a compound releasing active chlorine in aqueous solution, 5% of low-sudsing nonionic surface active compounds were the suds level of the low-sudsing nonionic surface-active compounds according to DIN 53,902 is from 10 to 80 ml of 50° C, 7% by weight of anhydrous trisodium citrate, and 3% by weight of sodium acetate.

* * * * *